United States Patent [19]

Sando et al.

[11] 4,055,970

[45] Nov. 1, 1977

[54] HIGH TEMPERATURE AND HIGH PRESSURE STEAMER

[75] Inventors: Yoshikazu Sando; Hiroshi Ishidoshiro, both of Wakayama, Japan

[73] Assignee: Sando Iron Works Co., Ltd., Wakayama, Japan

[21] Appl. No.: 676,401

[22] Filed: Apr. 13, 1976

[30] Foreign Application Priority Data

Apr. 22, 1975 Japan ..... 50-48771

[51] Int. Cl.[2] ..... D06B 23/18

[52] U.S. Cl. ..... 68/5 E

[58] Field of Search ..... 68/5 E; 34/242

[56] References Cited

U.S. PATENT DOCUMENTS

| | | | |
|---|---|---|---|
| 2,974,512 | 3/1961 | Carter | 68/5 E |
| 3,083,073 | 3/1963 | Leins et al. | 68/5 E X |
| 3,695,064 | 10/1972 | Runton | 68/5 E |

FOREIGN PATENT DOCUMENTS

| | | | |
|---|---|---|---|
| 2,228,440 | 1/1974 | Germany | 68/5 E |
| 277,525 | 11/1964 | Netherlands | 68/5 E |
| 342,687 | 7/1973 | U.S.S.R. | 68/5 E |

*Primary Examiner*—Philip R. Coe

*Attorney, Agent, or Firm*—Toren, McGeady and Stanger

[57] ABSTRACT

A high temperature and high pressure steamer which is made so it is possible to process a cloth giving the cloth impregnation or humidity of liquid in a suitable manner within a sealing mechanism of said high temperature and high pressure steamer when said cloth is processed by the steamer.

1 Claim, 4 Drawing Figures

HIGH TEMPERATURE AND HIGH PRESSURE STEAMER

BACKGROUND OF THE INVENTION

In the conventional processing of cloth by a high temperature and high pressure steamer, generally, said cloth is impregnated with liquid outside the vessel body of a high temperature and high pressure steamer, then said liquid impregnated cloth is brought into said vessel body through a sealing mechanism.

Therefore, since said sealing mechanism has at least a pair of roll seals or nip seals and has a liquid impregnated cloth pass through between said pair of roll seals or between nip seals, the liquid impregnated in the cloth is squeezed out as the cloth passes through said sealing part, thus desired humidity or impregnation volume can not be secured in said cloth brought into the vessel body and often effective processing can not be accomplished, resulting in such defects as defective dyeing by insufficient humidity, poor feeling, and improper fulling, etc.

The present invention is made to eliminate such shortcomings and is to provide a high pressure steamer having a liquid processing mechanism which also serves as a sealing mechanism and has a seal block having a seal roll group to close a cloth path, a reduced pressure vapor chamber connected to said cloth path of the seal block and having valve seats in its inside, and a liquid seal tank provided between said reduced pressure vapor chamber and said seal block, being provided at a cloth take in inlet or at a cloth take out outlet of said high temperature and high pressure steamer.

Therefore, since cloth is subjected to liquid processing after it goes through a seal block of a high temperature and high pressure vessel body and then is supplied to within the vessel body in this high pressure steamer, such effective processing or working can be done as eliminating the short-coming of squeezing the liquid impregnated in a cloth to unnecessarily high degree, etc.

Also, an object of the present invention is to place a processing liquid tank or a liquid seal tank inside of a high temperature and high pressure vessel body so that grey cloth (unprocessed cloth) is made to pass through a seal block to provide liquid processing or give suitable amount of humidity to the cloth within the vessel body.

Further, the present invention is to connect a liquid supply tube and a liquid exhaust tube to a liquid seal tank which constitutes a liquid processing mechanism also serving as a sealing mechanism so that supply or exchange of liquid to or in the liquid seal tank can be made easily.

Now, the present invention will be described in detail based on examples shown in the drawings.

BRIEF DESCRIPTION OF THE DRAWINGS

The drawings show examples of the present invention, and

Figure 1:
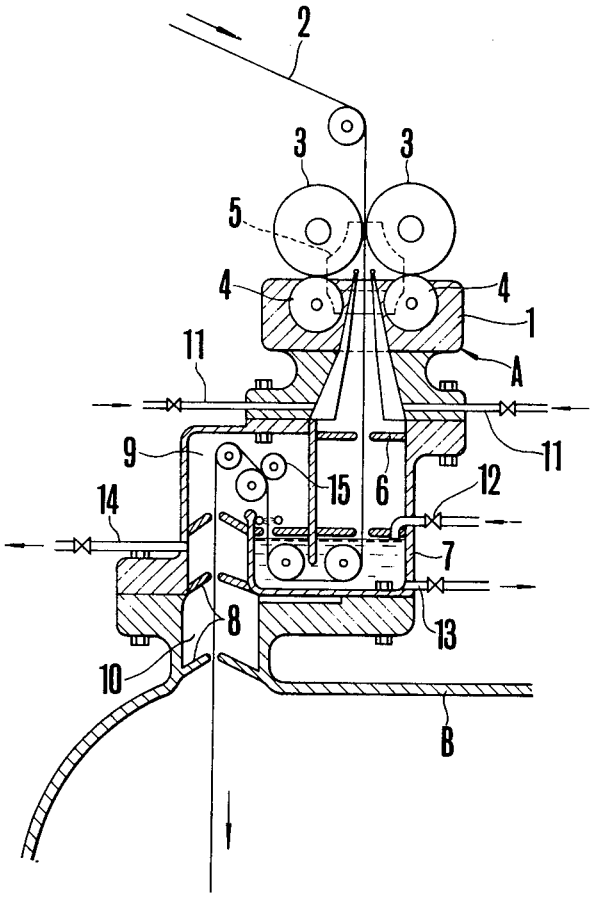
FIG. 1 is a cross sectional view showing the internal structure of a liquid processing mechanism which also serves as a sealing mechanism.

First, a structure of a liquid processing mechanism (A) also serving as a sealing mechanism will be explained in detail based on FIG. 1.

1 is a seal block which is made by assembling a pair of seal rolls 3 blocking a path which can have a cloth 2 pass therethrough, metal rolls 4 being pressure contacted with said seal rolls from underside thereof and end plane seal plates 5 being pressure contacted with both ends of each of said rolls, and a liquid seal tank 7 of U-shape is connected to the bottom of said seal block 1 through valve seats 6.

Further, a reduced pressure vapor chamber 9 of reverse U-shape having dividing chambers formed by plural number of valve seats 8 is connected to the other end of said U-shape liquid seal tank 7, and a cloth guide opening 10 for a high temperature and high pressure vessel body B is connected to the other end of said reduced pressure vapor chamber 9. And 11 is a pressurized air blow in tube to supply air to between the seal block 1 and the liquid seal tank 7, and 12 is a liquid supply tube to supply liquid into the liquid seal tank 7, while 13 is a liquid exhaust tube to discharge the liquid from said liquid seal tank 7. 14 is a pressure reducing exhaust tube connected to the reduced pressure vapor chamber 9, and 15 is a tare weight squeeze roll.

Now, while the cloth 2 passing vertically through the seal block 1 goes through the liquid seal tank 7 and the reduced pressure vapor chamber 9 and is supplied to inside of the vessel body B, since the cloth 2 supplied to said vessel body is subjected to liquid processing within the liquid seal tank 7 after going through the seal block 1, there will be no squeezing of liquid by the seal rolls, etc., and the cloth can be supplied to inside of the vessel body B with desired liquid processing done thereon or with desired amount of liquid contained therein.

Also, since the liquid supply tube 12 and the liquid exhaust tube 13 connected to the liquid seal tank are provided in the present invention, a prescribed amount of liquid is always supplied in said liquid seal tank, and exchange of said liquid can be done easily as required, thus desired liquid processing can be effected continuously.

Figure 2:
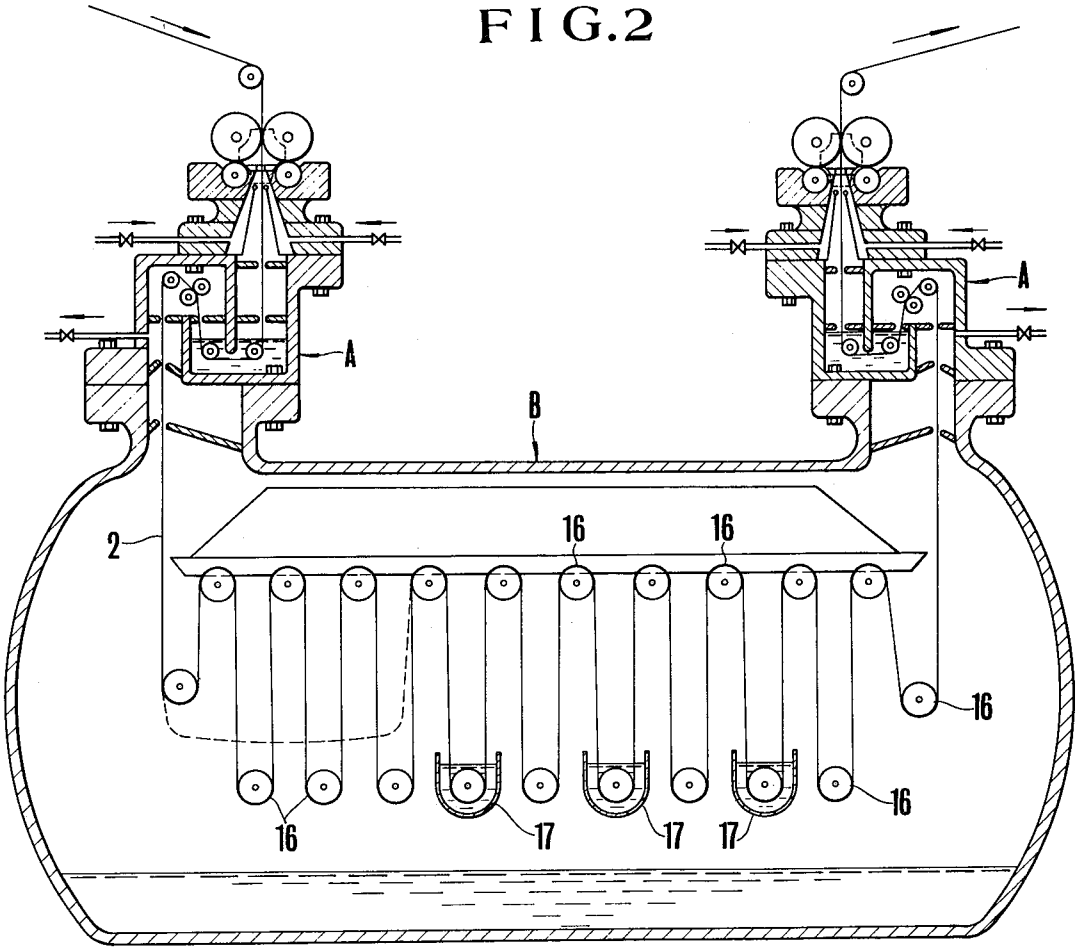
FIG. 2 is a cross sectional view showing the internal structure of a high pressure steamer having said liquid processing mechanism which also serves as a sealing mechanism.

While the structure and functional effect of the liquid processing mechanism A serving also as the sealing mechanism are as mentioned above, next, embodiment examples of said mechanism A will be explained. In FIG. 2, said mechanism A is provided at each of a cloth take in inlet and a cloth take out outlet of a vessel body B which comprises a number of up and down steam blow out roll group 16 which also serve as guide rolls to transport the cloth 2 in a meandering manner up and down, and liquid tanks 17 to impregnate liquid into or give humidity to the cloth transported by said steam blow out roll group, being provided at suitable positions.

Figure 3:
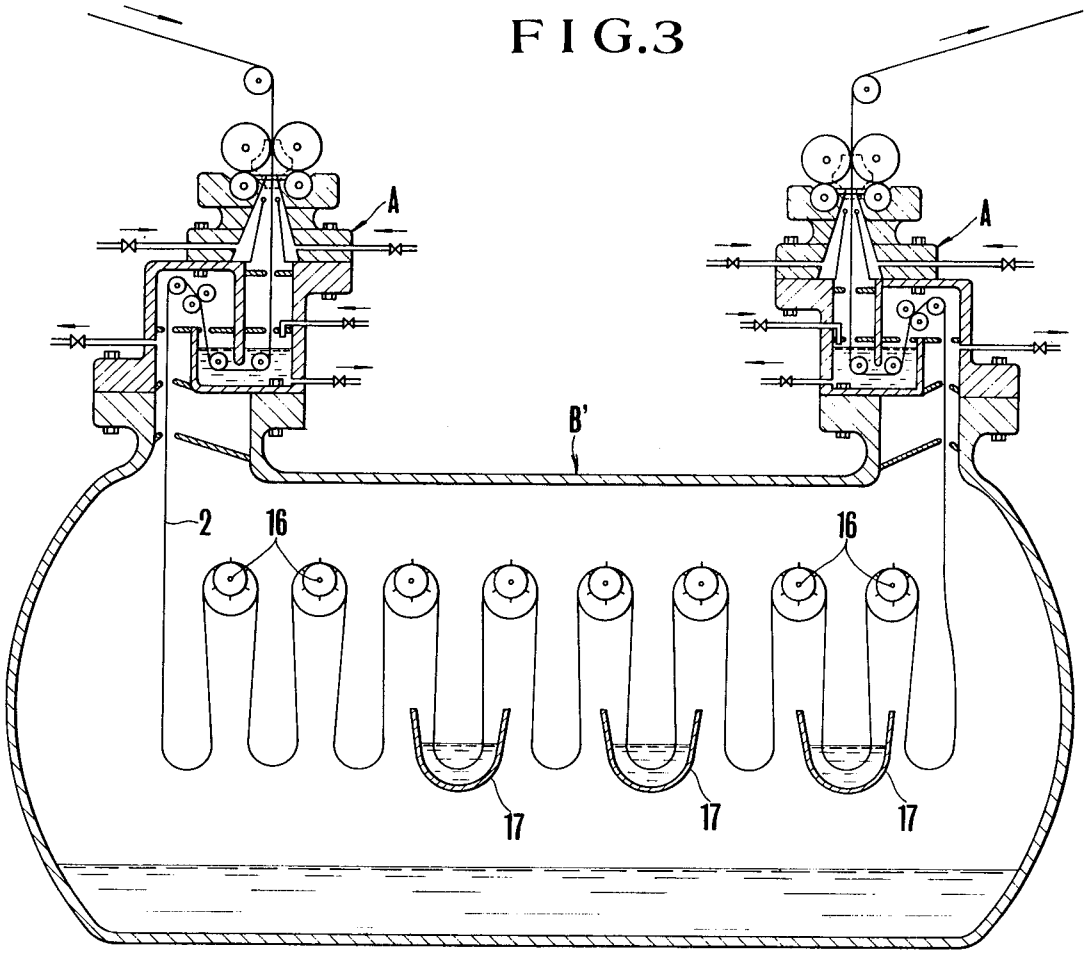
FIGS. 3 and 4 are cross sectional views of high pressure steamers showing other examples.

In the example shown in FIG. 3, steam blow out rolls 16 also serving as guide rolls are provided with constant intervals therebetween at upper row only and liquid tanks 17 to impregnate liquid or give humidity to a cloth being transported by said steam blow out rolls are provided at suitable positions within a vessel body B', and the above mentioned mechanism A is provided at each of a cloth take in inlet and a cloth take out outlet of said body B'.

Figure 4:
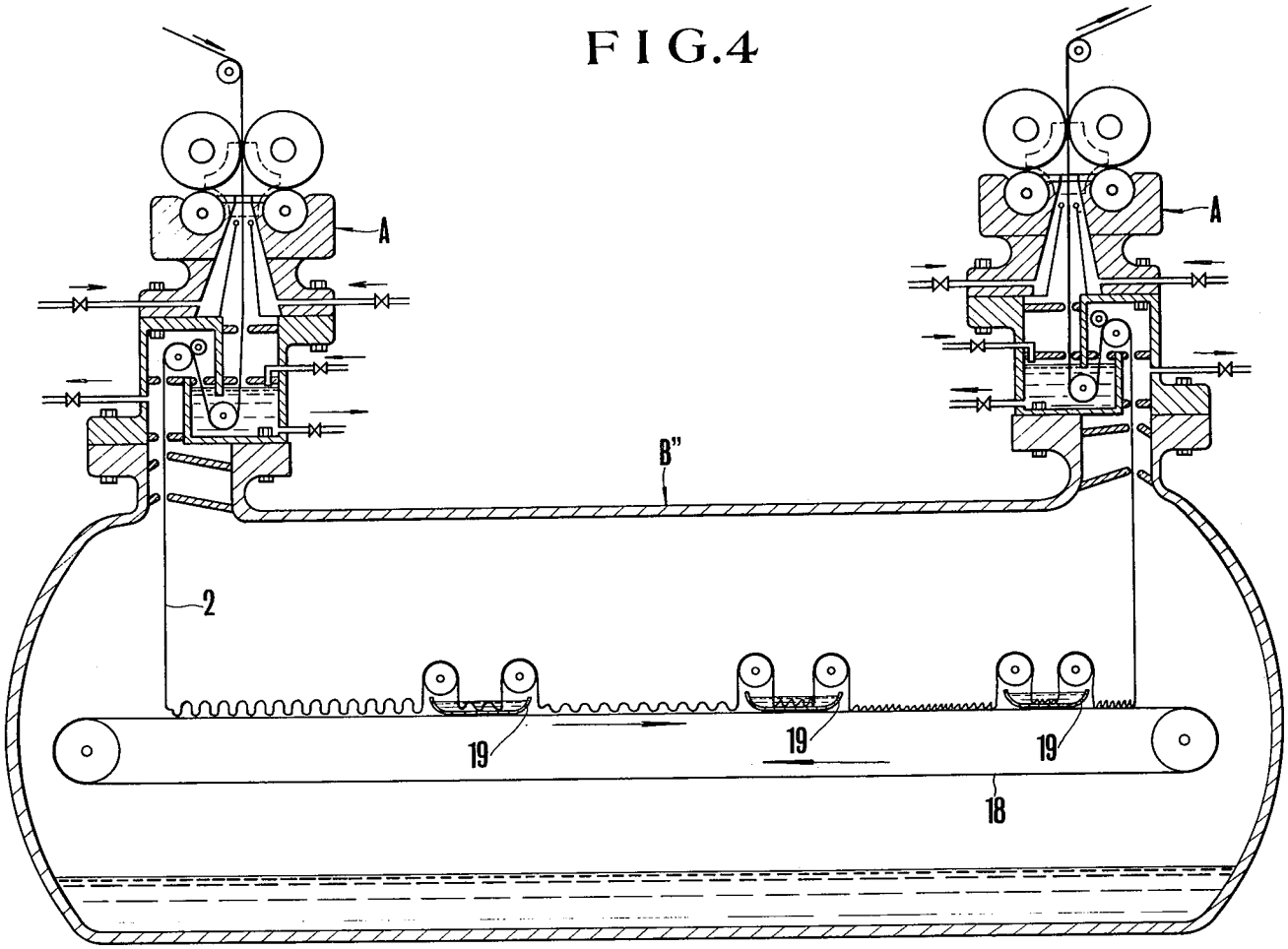

In the example, shown in FIG. 4, the above mentioned mechanism A is provided at each of a cloth take in inlet and a cloth take out outlet of a vessel body B" comprising a conveyor 18 to place the cloth thereon and transport the same in no tension state, and liquid vessels 19 to impregnate liquid or give humidity to the cloth 2 transported by said conveyor being provided at suitable positions.

As has been mentioned above, in the present invention the above mentioned liquid processing mechanism also serving as a sealing mechanism is provided at a cloth take in inlet of a high temperature and high pressure steamer, therefore the cloth supplied to inside of a vessel body will have liquid processing done thereon after going through a seal block and then said cloth is supplied to inside of the vesel body, thus such shortcoming will be eliminated as squeezing-out of the liquid impregnated in the cloth by seal rolls, etc. Therefore, it is particularly advantageou for dyeing of cloth.

What is claimed is:

1. A high temperature and high pressure steamer for liquid processing cloth comprising a high temperature and high pressure steamer vessel body having a cloth inlet and a cloth outlet, said cloth inlet comprising a seal block having a seal roll group through which the cloth passes as it enters said steamer vessel and said seal roll group forming a block between the exterior and the interior of said steamer vessel for the cloth entering therein, a reduced pressure vessel chamber located within said steamer vessel arranged between said seal block and the interior of said steamer vessel so that the cloth passes from said seal block through said reduced pressure vessel chamber before entering into the interior of said steamer vessel, said reduced pressure vessel chamber being reduced in pressure relative to the interior of said steamer vessel, said reduced pressure vessel chamber having a valve seat within the interior thereof, and a liquid seal tank arranged to contain a body of liquid therein and located between said seal block and said reduced pressure vessel chamber so that the cloth entering through said seal block passes first through said liquid seal tank traversing the body of liquid therein and then enters said reduced pressure vessel chamber before entering the interior of said vessel, and said liquid seal tank having a liquid supply tube and liquid exhaust tube for introducing liquid into and removing liquid from said tank.

* * * * *